US009188920B2

(12) United States Patent
Kawahata

(10) Patent No.: US 9,188,920 B2
(45) Date of Patent: Nov. 17, 2015

(54) FIXING DEVICE, AND IMAGE FORMING APPARATUS

(71) Applicant: FUJI XEROX CO., LTD., Tokyo (JP)

(72) Inventor: Yasushi Kawahata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/474,851

(22) Filed: Sep. 2, 2014

(65) Prior Publication Data

US 2015/0268604 A1 Sep. 24, 2015

(30) Foreign Application Priority Data

Mar. 18, 2014 (JP) ..... 2014-055502

(51) Int. Cl.
*G03G 15/20* (2006.01)
*G03G 15/00* (2006.01)

(52) U.S. Cl.
CPC ..... *G03G 15/2053* (2013.01); *G03G 15/2007* (2013.01); *G03G 15/2021* (2013.01); *G03G 15/6573* (2013.01)

(58) Field of Classification Search
CPC ..... G03G 15/00708; G03G 15/2007; G03G 15/2021
See application file for complete search history.

(56) References Cited

U.S. PATENT DOCUMENTS

| | | | | |
|---|---|---|---|---|
| 7,169,524 | B2 * | 1/2007 | Nakamura et al. | 430/108.4 |
| 7,711,309 | B2 * | 5/2010 | Okazaki | 399/388 |
| 7,840,150 | B2 * | 11/2010 | Mori et al. | 399/69 |
| 8,190,061 | B2 * | 5/2012 | Kawahata et al. | 399/122 |
| 2011/0026991 | A1 | 2/2011 | Izawa et al. | |
| 2011/0182607 | A1 * | 7/2011 | Takemura | 399/67 |

FOREIGN PATENT DOCUMENTS

| | | |
|---|---|---|
| JP | A-61-262771 | 11/1986 |
| JP | A-10-307495 | 11/1998 |
| JP | A-2011-33650 | 2/2011 |
| JP | 2011118397 A * | 6/2011 |

* cited by examiner

*Primary Examiner* — Clayton E Laballe
*Assistant Examiner* — Leon W Rhodes, Jr.
(74) *Attorney, Agent, or Firm* — Oliff PLC

(57) ABSTRACT

Provided is a fixing device including a heating section that is arranged to be out of contact with a recording medium which is transported, and heats a developer image on the recording medium, a contact member that is arranged on a downstream side from the heating section in a transport direction of the recording medium, and is in contact with an image surface on a developer image side of the recording medium, and a folding member that is arranged between the heating section and the contact member, and folds a transport path of the recording medium from the heating section to the contact member to a side opposite to an image surface side from an extended line so that the contact member is positioned on the opposite side of the heating section from an extended line of the transport path which faces the heating section.

11 Claims, 7 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2014-055502 filed Mar. 18, 2014.

BACKGROUND

Technical Field

The present invention relates to a fixing device, and an image forming apparatus.

SUMMARY

According to an aspect of the invention, there is provided a fixing device including:

a heating section that is arranged to be out of contact with a recording medium which is transported, and heats a developer image on the recording medium;

a contact member that is arranged on a downstream side from the heating section in a transport direction of the recording medium, and is in contact with an image surface on a developer image side of the recording medium; and a folding member that is arranged between the heating section and the contact member, and folds a transport path of the recording medium from the heating section to the contact member to a side opposite to an image surface side from an extended line so that the contact member is positioned on the opposite side of the heating section from an extended line of the transport path which faces the heating section.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, examples of a fixing device and an image forming apparatus according to a first exemplary embodiment will be described with reference to the accompanying drawings. An overall configuration and an operation of the image forming apparatus will be described first, and then a configuration and an operation of the fixing device, which is a main portion of this exemplary embodiment, will be described.

In the following description, a direction illustrated with an arrow Z in FIG. 1 will be referred to as an apparatus height direction, and a direction illustrated with an arrow X in FIG. 1 will be referred to as an apparatus width direction. In addition, a direction (illustrated as Y) orthogonal to each of the apparatus height direction and the apparatus width direction will be referred to as an apparatus depth direction. The apparatus height direction, the apparatus width direction, and the apparatus depth direction will be referred to as a Z direction, an X direction, and a Y direction when an image forming apparatus 10 is viewed (front view) from a side where a user (not illustrated) stands.

Moreover, in a case where one sides and the other sides of the X direction, the Y direction, and the Z direction have to be distinguished, an upper side will be referred to as a side, a lower side will be referred to as a −Z side, a right side will be referred to as a +X side, a left side will be referred to as a −X side, a depth side will be referred to as a +Y side, and a front side will be referred to as a −Y side in the front view of the image forming apparatus 10.

Overall Configuration

Figure 1:
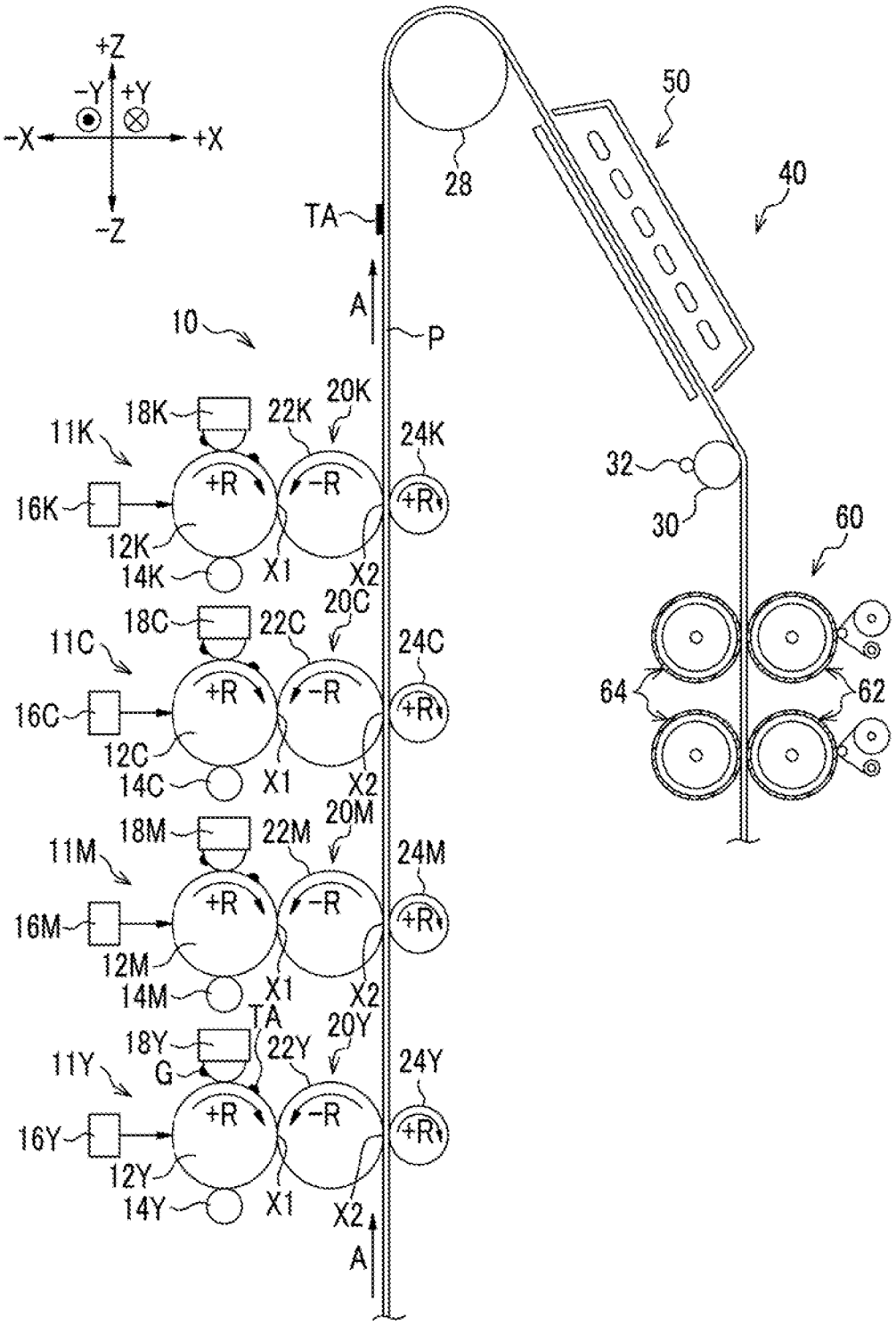
FIG. 1 is a schematic diagram illustrating an overall configuration of an image forming apparatus according to a first exemplary embodiment.

As illustrated in FIG. 1, the image forming apparatus 10 includes four image forming units 11Y, 11M, 11C, and 11K, a feed roller 28, a winding roller 30, and a fixing device 40. The image forming units 11Y, 11M, 11C, and 11K are examples of developer image forming units. The feed roller 28 constitutes a part of a transporting device (not illustrated) that transports a sheet P. The winding roller 30 will be described in detail later.

Among the indices of the signs, "Y" represents yellow, "M" represents magenta, "C" represents cyan, and "K" represents black. In addition, the arrangement of the respective units in the image forming apparatus 10 that correspond to the respective colors is in the order of Y, M, C, and K in a transport direction of the sheet P (described later) from the upstream side.

The transporting device (not illustrated) transports the sheet P as an example of a recording medium in an arrow A direction (transport direction) in the drawing at a predetermined transport speed. The sheet P is continuous paper, and, as an example, is transported from the −Z side to the +Z side on the upstream side from the feed roller 28 in the transport direction and is transported from the +Z side to the −Z side on the downstream side from the feed roller 28 in the transport direction. The transport speed of the sheet P is, for example, 60 [m/min].

In addition, in the transport direction of the sheet P, the feed roller 28 is arranged on the downstream side from the four image forming units 11Y, 11M, 11C, and 11K and the fixing device 40 is arranged on the downstream side from the feed roller 28. An operation of each portion of the image forming apparatus 10 is controlled by a control unit (not illustrated).

The image forming units 11Y, 11M, 11C, and 11K respectively have cylindrical photoconductors 12Y, 12M, 12C, and 12K that hold electrostatic latent images, charging devices 14Y, 14M, 14C, and 14K, and exposure devices 16Y, 16M, 16C, and 16K. Moreover, the image forming units 11Y, 11M, 11C, and 11K respectively further have developing devices 18Y, 18M, 18C, and 18E, and transfer devices 20Y, 20M, 20C, and 20K.

Photoconductor

Each of the photoconductors 12Y, 12M, 12C, and 12K is rotatable in an arrow +R direction (clockwise direction) in the drawing. In addition, the charging devices 14Y, 14M, 14C, and 14K, the exposure devices 16Y, 16M, 16C, and 16K, and the developing devices 18Y, 18M, 18C, and 18K are arranged around the photoconductors 12Y, 12M, 12C, and 12K in this order in the +R direction. Moreover, the transfer devices 20Y, 20M, 20C, and 20K are arranged between the developing devices 18Y, 18M, 18C, and 18K and the charging devices 14Y, 14M, 14C, and 14K in the +R direction around the photoconductors 12Y, 12M, 12C, and 12K.

Charging Device and Exposure Device

The charging devices 14Y, 14M, 14C, and 14K are, for example, rollers to which voltage is applied, and charge outer circumferential surfaces of the photoconductors 12Y, 12M, 12C, and 12K. The exposure devices 16Y, 16M, 16C, and 16K expose the outer circumferential surfaces of the photoconductors 12Y, 12M, 12C, and 12K, which are charged by the charging devices 14Y, 14M, 14C, and 14K, based on image data, and form the electrostatic latent images.

Developing Device

The developing devices 18Y, 18M, 18C, and 18K develop the electrostatic latent images that are formed on the outer circumferential surfaces of the photoconductors 12Y, 12M, 12C, and 12K by the exposure devices 16Y, 16M, 16C, and 16K with developer G, and obtain a visible toner image TA. The toner image TA is an example of a developer image. The developer G that is used in the developing devices 18Y, 18M, 18C, and 18K is, for example, configured by using powder toner T (refer to FIG. 3) which contains 9 [% by mass] of wax WX (refer to FIG. 3) and uses a polyester resin (binder resin) as a main ingredient.

The wax WX may be a natural wax and may be a synthetic wax. Examples of the wax WX include paraffin wax and microcrystalline wax as petroleum wax, carnauba wax and candelilla wax as vegetable wax, beeswax and spermaceti as animal wax, and polyethylene wax and amide wax as synthetic wax. In addition, products altered therefrom or mixtures thereof may also be used. The wax WX is, for example, the paraffin wax in this exemplary embodiment.

However, the wax WX has to be selected with an appropriate melting point in view of the softening point of the binder resin of the toner T. In addition, a case where the toner T not containing the wax WX is used may be responded to when a member that is in contact with the unfixed toner image TA or a section that applies release oil to the toner image TA itself is disposed on the upstream side from a fixing portion 60 (described later, refer to FIG. 2). A liquid developer that contains a carrier liquid which is configured by using oil may also be used instead of the wax WX.

Transfer Device

The transfer devices 20Y, 20M, 20C, and 20K have intermediate transfer rollers 22Y, 22M, 22C, and 22K and image transfer rollers 24Y, 24M, 24C, and 24K. The transfer device 20Y and the transfer devices 20M, 20C, and 20K are similar to each other in configuration with the exception of the toner T (refer to FIG. 3), and thus only the transfer device 20Y will be described herein and description of the transfer devices 20M, 20C, and 20K will be omitted.

The intermediate transfer roller 22Y is in contact with the photoconductor 12Y at a primary image transfer position X1 on the upstream side from the charging device 14Y and on the downstream side from the developing device 18Y in a direction of rotation of the photoconductor 12Y, and is driven to rotate in a direction illustrated with an arrow −R (counterclockwise direction). As such, in the transfer device 20Y, the toner image TA that is formed on the outer circumferential surface of the photoconductor 12Y by the developer is subjected to primary image transfer to the intermediate transfer roller 22Y at the primary image transfer position X1. A primary image transfer voltage (bias voltage) is applied, by power supply (not illustrated), between the photoconductor 12Y and the intermediate transfer roller 22Y.

The image transfer roller 24Y is arranged to face the intermediate transfer roller 22Y on the side opposite to the photoconductor 12Y. The image transfer roller 24Y rotates in the direction illustrated with the arrow +R when the sheet P is fed between the intermediate transfer roller 22Y and the image transfer roller 24Y. Herein, a position where the intermediate transfer roller 22Y is in contact with the sheet P is a secondary image transfer position X2, and the toner image TA that is subjected to the primary image transfer to the intermediate transfer roller 22Y is subjected to secondary image transfer to the sheet P at the secondary image transfer position X2. A secondary image transfer voltage (bias voltage) is applied between the intermediate transfer roller 22Y and the image transfer roller 24Y.

Herein, a transport path of the sheet P is arranged in the Z direction to the feed roller 28, and is arranged in an inclined direction, falling to the −Z side toward the +X side, from the feed roller 28 to the winding roller 30 (described later). Moreover, the downstream side of the transport path, of the sheet P from the winding roller 30 is arranged in the Z direction.

Image Forming Operation

An image is formed as follows in the image forming apparatus 10.

In the image forming unit 11Y, the photoconductor 12Y rotates and the outer circumferential surface of the photoconductor 12Y is charged by the charging device 14Y. Then, the charged outer circumferential surface of the photoconductor 12Y is subjected to exposure scanning by the exposure device 16Y so that the electrostatic latent image (not illustrated) of a first color (Y) is formed on the outer circumferential surface of the photoconductor 12Y. The electrostatic latent image is developed by the developing device 18Y, and the toner image TA that is visualized is formed on a surface of the photoconductor 12Y.

The toner image TA reaches the primary image transfer position X1 due to the rotation of the photoconductor 12Y, and is subjected to the primary image transfer to the intermediate transfer roller 22Y due to the primary image transfer voltage. The toner image TA that is transferred to the intermediate transfer roller 22Y reaches the secondary image transfer position X2 due to the rotation of the intermediate transfer roller 22Y, and is subjected to the secondary image transfer to the sheet P due to the secondary image transfer voltage.

Likewise, the toner images TA of a second color (M), a third color (C), and a fourth color (K) that are formed by the image forming units 11M, 11C, and 11K are sequentially transferred via the intermediate transfer rollers 22M, 22C, and 22K to be superposed on the sheet P. The transport speed of the sheet P is synchronized with the rotational speeds of the photoconductors 12Y, 12M, 12C, and 12K so that positions of the toner images TA of the respective colors are not shifted on the sheet P. As such, the multiple toner images TA are formed on the sheet P. The multiple toner images TA are subjected to a heating treatment and a pressure treatment in the fixing device 40 (described later) and are fixed on the sheet P.

After the primary image transfer of the toner image TA to the intermediate transfer roller 22Y is completed, the photoconductor 12Y is cleaned by a cleaner (not illustrated). In addition, the outer circumferential surface of the intermediate transfer roller 22Y is also cleaned by the cleaner (not illustrated) after the completion of the secondary image transfer of the toner image TA to the sheet P.

In a case where a monochromatic image, for example, a black (K) image, is formed on the sheet P, the other image forming units 11Y, 11M, and 11C are separated (withdrawn) from the intermediate transfer rollers 22Y, 22M, and 22C.

Configuration of Main Portion

Next, the fixing device 40 will be described.

Figure 2:
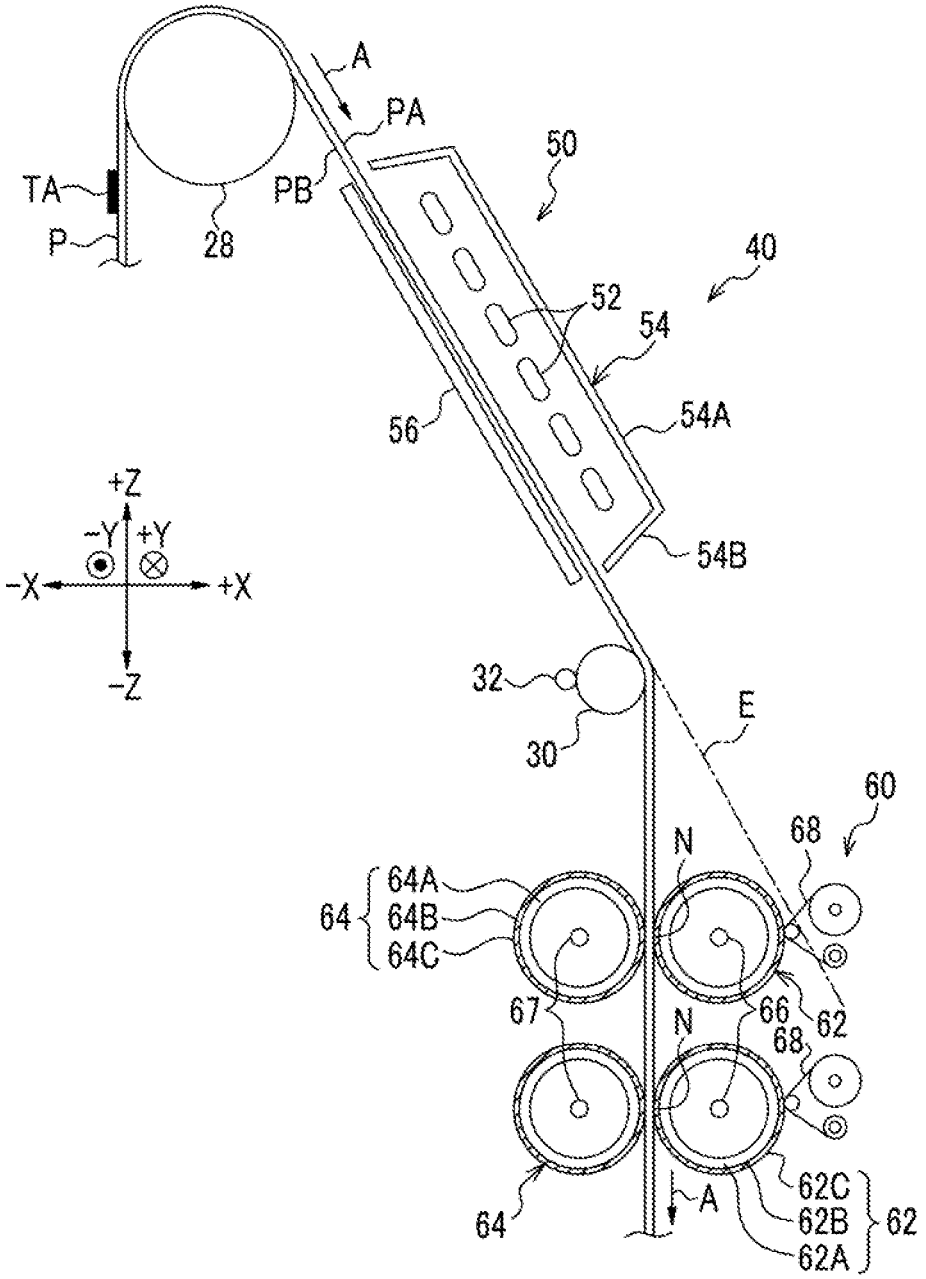
FIG. 2 is a schematic diagram illustrating a configuration of a fixing device according to the first exemplary embodiment.

As illustrated in FIG. 2, the fixing device 40 has, for example, a heating unit 50 as an example of a heating section, the fixing portion 60 that fixes the toner image TA which is heated, by the heating unit 50 to the sheet P, and the winding roller 30 as an example of a folding member and a rotating body.

Heating Unit

The heating unit 50 has, for example, six carbon heaters 52. The six carbon heaters 52 are disposed, apart from each other in the transport direction, on the toner image TA side of the sheet P on the upstream side from the winding roller 30 in the transport direction (A direction) of the sheet P, and are arranged out of contact with the sheet P. When electrified, the carbon heaters 52 generate far infrared rays toward the sheet p and heat the sheet P and the toner image TA. In the following description, a surface of the sheet P on a side where the toner image TA is formed will be referred to as an image surface PA, and a surface of the sheet P on a side where the toner image TA is not formed (side opposite to the image surface PA side) will be referred to as a no-image surface PB.

In this exemplary embodiment, outputs and heating temperatures of the carbon heaters 52 are set so that, for example, a white background portion is at 90° C. and the toner image TA is at 110° C. on the image surface PA. In other words, the heating unit 50 heats the toner image TA at a temperature that is lower than a fixing temperature of the fixing portion 60 (described later). Specifically, the carbon heaters 52 are 4 [KW] in rating and 600 [mm] in Y-direction length.

In addition, the six carbon heaters 52 are covered by a cover 54. The cover 54 has a flat plate portion 54A that covers the side opposite to the sheet P side of the carbon heaters 52, and an inclined portion 54B that obliquely extends from an end of the flat plate portion 54A toward the sheet P. A gap is formed between an end of the inclined portion 54B and the image surface PA of the sheet P.

Moreover, a reflection plate 56 is disposed at a position facing the six carbon heaters 52 and on the no-image surface PB side of the sheet P. The reflection plate 56 is configured by, for example, using a plate material of the A1050P material on which a mirror surface treatment is performed. In addition, the reflection plate 56 is arranged in the transport direction, 10 [mm] apart from the sheet P.

Herein, a line that faces the heating unit 50, along which the transport path of the sheet P is extended toward the downstream side, is referred to as an extended line E. The extended line E is a line in a common tangent of the feed roller 28 and the winding roller 30 (described later) where the feed roller 28 and the winding roller 30 are arranged on the same side with respect to the common tangent and the common tangent at a part close to the carbon heaters 52 is extended. The extended line E is a line in two dimensions (X-Z plane), but an extended plane in three dimensions.

Fixing Portion

The fixing portion 60 has fixing rollers 62 as an example of a fixing member and a contact member, and press rollers 64 that nip and pressurize the sheet P with the fixing rollers 62. As an example, two sets of the fixing rollers 62 and the press rollers 64 are arranged, in the fixing portion 60 apart from each other in the transport direction (A direction) of the sheet P.

Fixing Roller

The fixing rollers 62 are formed to have a cylindrical shape, and are arranged to be rotatable in the Y direction as an axial direction on the downstream side from the heating unit 50 and the winding roller 30 in the transport direction of the sheet P and on the +X side of the sheet P. Specifically, the fixing rollers 62 are arranged on the +X side of the sheet P in the Z direction and on the −X side from the extended line E (described above) since the transport path of the sheet P is folded by the winding roller 30 (described later). The fixing rollers 62 are in contact with the image surface PA of the sheet P, and fix the toner image TA on the sheet P.

In addition, the fixing roller 62 has a multilayer structure that has a core roller 62A, an elastic layer 62B, and a release layer 62C from an inner side toward an outer side in a radial direction. In other words, the fixing roller 62 has the release layer 62C formed on an outer circumferential surface of the elastic layer 62B to be in contact with the toner image TA and the wax WX (refer to FIG. 3).

The core roller 62A is configured to have stainless steel (SUS) hubs (locations where bearings are mounted) disposed in both axial end portions of a pipe material formed of an aluminum alloy. The elastic layer 62B is formed, for example, of silicone rubber with a radial thickness of 4 [mm] and a shore A hardness of A30. The release layer 62C is formed, for example, of a tetrafluoroethylene-perfluoroalkoxyethylene copolymer (PFA) with a radial thickness of 100 [μm]. The fixing roller 62 is, for example, 108 [mm] in outer diameter and 580 [mm] in axial length.

Moreover, halogen heaters 66 are disposed inside the fixing rollers 62. The halogen heaters 66 generate heat and heat the fixing rollers 62 from the inside when electrified by power supply (not illustrated). In addition, the halogen heaters 66 are, for example, subjected to feedback control based on an output of a temperature sensor (not illustrated) that detects the temperature of the fixing roller 62 so that the temperature of the outer circumferential surface of the fixing roller 62 is maintained at 130° C.

A cleaning web 68 is in contact with a location on the side opposite to the press roller 64 side and on the outer circumferential surface of the fixing roller 62. The cleaning web 68 removes the wax adhering to the outer circumferential surface of the fixing rollers 62.

Press Roller

The press rollers 64 are formed to have a cylindrical shape, and are disposed to be rotatable in the Y direction as an axial direction on the −X side of the sheet P. In addition, the press roller 64 has a multilayer structure that has a core roller 64A, an elastic layer 64B, and a release layer 64C from an inner side toward an outer side in the radial direction. Moreover, the press roller 64 is biased toward the fixing roller 62 by using a biasing section (not illustrated) such as a spring. As an example, the core roller 64A and the core roller 62A, the elastic layer 64B and the elastic layer 62B, and the release layer 64C and the release layer 62C respectively have similar configurations to each other in this exemplary embodiment, and thus description will be omitted. In addition, halogen heaters 67 are disposed inside the press rollers 64.

The halogen heaters 67 generate heat and heat the press rollers 64 from the inside when electrified by power supply (not illustrated). In addition, the halogen heaters 67 are, for example, subjected to feedback control based on the output of the temperature sensor (not illustrated) that detects the temperature of the fixing roller 62 so that the temperature (fixing temperature) of the outer circumferential surface of the fixing roller 52 is maintained at 130° C.

A latch mechanism (not illustrated) that performs a contact and separation operation on the fixing roller 62 is disposed in the press roller 64 to allow contact between the fixing roller 62 and the press roller 64 and withdrawal of the press roller 64 from the fixing roller 62. Load application to contact portions N (nip portions) where the fixing rollers 62 and the press rollers 64 are in contact with each other is by a constant load method with a load value of, for example, 2,450 [N]. The latch mechanism may also allow the fixing roller 62 and the press roller 64 to be in contact with or withdraw from the sheet P.

Winding Roller

The winding roller 30 is formed, for example, to have a cylindrical shape, and is arranged to be rotatable in the Y direction as an axial direction on the −X side of the sheet P between the heating unit 50 and the fixing rollers 62. Specifically, the winding roller 30 is positioned on the +X side and the −Z side with respect to an end position of the inclined portion 54B of the cover 54, and is arranged at a position on the +Z side of the press roller 64. In addition, the winding roller 30 is formed, for example, of stainless steel (SUS).

An outer circumferential surface of a cleaning roller 32 as an example of a cleaning section is in contact with the side of an outer circumferential surface of the winding roller 30 that is opposite (−X side) to the side which is in contact with the sheet P. In the cleaning roller 32, for example, a rubber material that has a release layer is disposed on an enter circumferential surface of a cored bar formed of SUS. The cleaning roller 32 may be driven to rotate in the Y direction as the axial direction in response to the rotation of the winding roller 30.

The winding roller 30 folds the transport path of the sheet P from the heating unit 50 to the fixing rollers 62 to the side (−X side) opposite to the image surface PA side (+X side) with respect to the extended line E of the transport path facing the heating unit 50 since the sheet P is wound around the outer circumferential surface of the winding roller 30. As such, the outer circumferential surface of the fixing roller 62 is positioned on the image surface PA side from the extended line E. In addition, the winding roller 30 is driven to rotate in response to the movement of the sheet P since the sheet P is transported in a state where the sheet P is in contact with the winding roller 30.

Comparative Example

A fixing device (not illustrated) in which the positions of the fixing rollers 62 are on the extended line E (refer to FIG. 2) will be described as a comparative example of the fixing device 40 according to this exemplary embodiment.

In the fixing device according to the comparative example, a part of the far infrared rays (electromagnetic waves) generated due to the heat generation by the carbon heaters 52 is absorbed (radiated (generated)) by the toner image TA or the sheet P. However, the far infrared rays that are not absorbed are reflected and diffused by the reflection plate 56 and the sheet P, and a part thereof is absorbed by a first-stage fixing roller 62. The first-stage fixing roller 62 is the fixing roller 62 that is at the closest position to the winding roller 30.

As such, in the fixing device according to the comparative example, the temperature of the first-stage fixing roller 62 rises (monotonic increase) to be equal to or higher than a preset temperature even when, for example, the fixing roller 62 is at the preset temperature and the electrification to the halogen heater 66 stops. In other words, in the fixing device according to the comparative example, it is difficult to control the temperature of the fixing roller 62 to the preset temperature, and so-called hot offset, in which the toner T (refer to FIG. 3) is excessively melted to be moved to the fixing roller 62, occurs.

In a configuration of another comparative example in which a heat insulating member is arranged between the heating unit 50 and the fixing portion 60, the heat insulating member is heated by the far infrared rays from the heating unit 50 to become a new heat source, and the excessive melting of the toner T occurs.

Effect

Next, effects of the first exemplary embodiment will be described.

As illustrated in FIG. 1, the transport of the sheet P is initiated due to the rotation of the feed roller 28 while the toner images TA are formed on the sheet P in the image forming units 11Y, 11M, 11C, and 11K. The transport speed of the sheet P is, for example, 60 [m/minute].

Then, as illustrated in FIG. 2, the carbon heaters 52 of the heating unit 50 are turned on, and a latch operation (contact operation) of the fixing rollers 62 and the press rollers 64 of the fixing portion 60 is performed. In this manner, the fixing rollers 62 and the press rollers 64 rotate driven by the movement of the sheet P.

Figure 3:
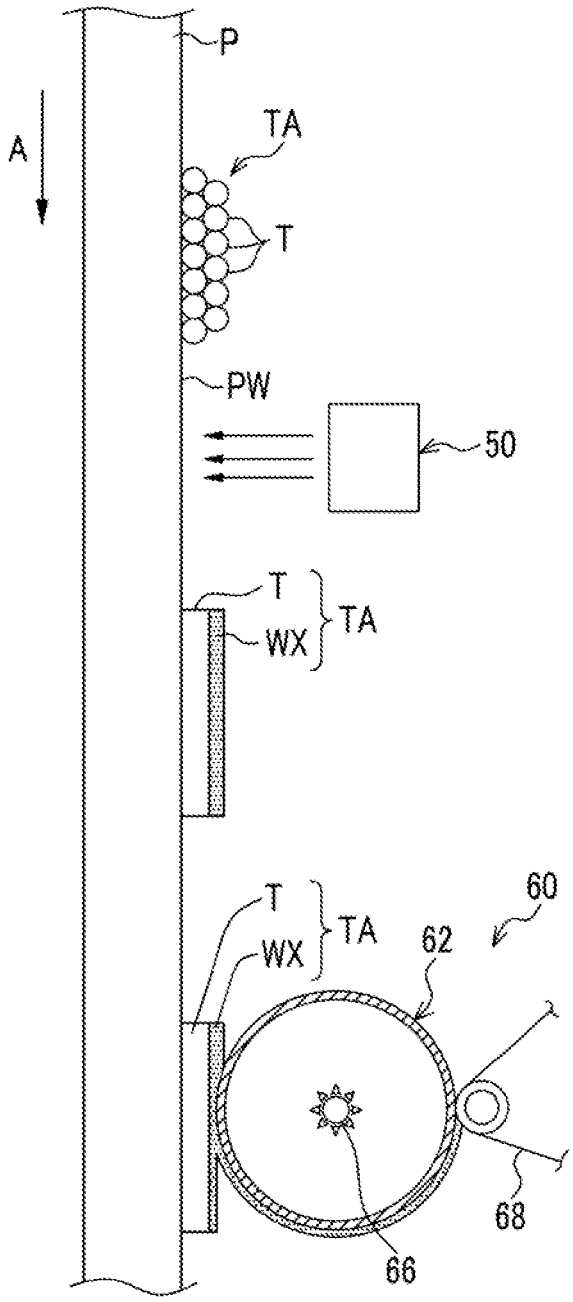
FIG. 3 is a schematic diagram illustrating a state where toner on a sheet is melted from a heating unit to a fixing portion according to the first exemplary embodiment.

Next, as illustrated in FIG. 3, the toner images TA on the sheet P are heated by the beating unit 50. Herein, as described above, the outputs of the carbon heaters 52 (refer to FIG. 2) of the heating unit 50 are set so that the white background portion PW of the sheet P is at 90° C. and the toner image TA is 110° C. in the black portion (K). The temperature of the black portion is 130° C. in a case where the black portions of the toner image TA are present on both surfaces (+X side and −X side) of the sheet P. In addition, the toner image TA has a temperature that is lower than the temperature of the black portion in the yellow portion, the magenta portion, and the cyan portion. This is because the heat absorption rates (infrared ray absorption rates) are different from each other by each of the colors. The heating unit 50 and the press roller 64 (refer to FIG. 2) on the back side (−X side) of the sheet P are not illustrated in FIG. 3.

Due to the heating by the heating unit 50, the toner T is melted and adhered (in a state of adhesion to be taken from the sheet P with greater ease than in the fixed state) to the sheet P and the wax WX that is contained in the toner T is also melted. Herein, the binder resin of the toner T is adheres to the sheet P due to the difference in compatibility between the binder resin of the toner T and the wax WX. The wax WX precipitates to a surface (fixing roller 62 side) of the toner T and forms a release film. In this manner, the toner T on the sheet P moves into the fixing portion 60 in a state of being separated into the binder resin and the release film.

Next, as illustrated in FIG. 2, the toner image TA of the sheet P passes the two contact portions N of the fixing portion 60, is heated and pressurized by the fixing rollers 62 and the press rollers 64 with a surface temperature of 130° C., and is fixed on the sheet P.

Herein, in the fixing device 40 according to the first exemplary embodiment, the transport path of the sheet P is folded to the no-image surface PB side from the extended line E by the winding roller 30. Accordingly, the far infrared rays (radiation) from the carbon heaters 52 rarely reach the fixing rollers 62 even though the far infrared rays (radiation) from the carbon heaters 52 are reflected and diffused by the reflection plate 56 and the sheet P. In other words, in the fixing device 40, the absorption of the far infrared rays that are not absorbed by the toner image TA and the sheet P by the fixing roller 62 (first-stage) is more suppressed than in the comparative example described above, and thus a rise in the temperature of the fixing rollers 62 (rise from the preset temperature) is suppressed.

In addition, in the fixing device 40, the winding roller 30 is driven to rotate due to the transport of the sheet P, and thus resistance that acts on the sheet P during the transport of the sheet P is smaller than in a configuration in which a member which folds the transport path of the sheet P does not rotate.

Moreover, in the fixing device 40, the sheet P is wound around the winding roller 30, and thus a contact area between the winding roller 30 and the sheet P increases and paper dust may adhere to the winding roller 30 compared to a case where the sheet P is not wound. However, in the fixing device 40, the cleaning roller 32 cleans the outer circumferential surface of the winding roller 30, and thus foreign substances (paper dust, dust, and the like) adhering to the outer circumferential surface of the winding roller 30 are removed. Accordingly, the adhesion (including retransfer of the paper dust) of the foreign substances to the sheet P is suppressed compared to a configuration in which the cleaning roller 32 is absent.

In addition, in the fixing device 40, the first-stage fixing roller 62 as an example of the contact member is set, and thus the distance from the heating unit 50 to the fixing portion 60 is shorter than in a configuration in which the contact member is a member other than the fixing roller 62. As such, dropping of the temperature of the sheet P, which passes the heating unit 50 and moves into the fixing portion 60, below the preset temperature is suppressed, and no unnecessary energy is consumed to heat the sheet P. Accordingly, the consumption of energy used to heat the toner T (refer to FIG. 3) is suppressed.

In the image forming apparatus 10 according to the first exemplary embodiment, rise of the temperature of the fixing rollers 62 above the preset temperature is suppressed, and thus the excessive melting of the toner T by the fixing rollers 62 is suppressed. As such, an image defect attributable to the movement of the overheated and melted toner T to the fixing rollers 62 (for example, decline in image glossiness due to an increase in irregularities on a surface of the toner image TA caused by the hot offset) may be suppressed.

Second Exemplary Embodiment

Next, examples of a fixing device and an image forming apparatus according to a second exemplary embodiment will be described. The same reference numerals as in the first exemplary embodiment will be attached to basically the same members and locations as in the first exemplary embodiment described above to omit description.

Figure 4:
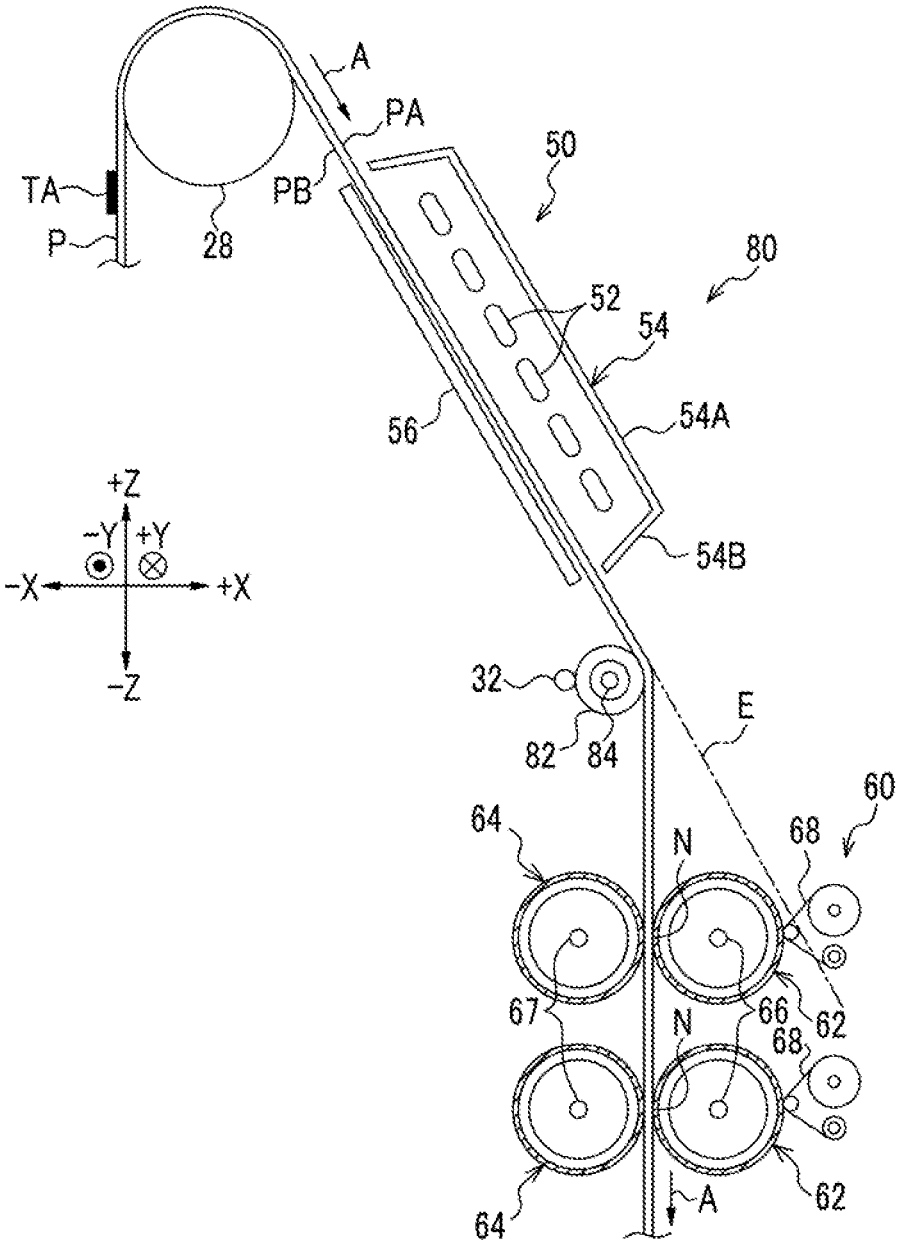
FIG. 4 is an explanatory diagram illustrating the configuration of the fixing device according to the first exemplary embodiment from the heating unit to the fixing portion.

FIG. 4 illustrates a fixing device 80 according to the second exemplary embodiment. In the fixing device 80, a winding roller 82 as an example of the folding member and the rotating body is disposed instead of the winding roller 30 in the image forming apparatus 10 according to the first exemplary embodiment (refer to FIG. 1).

The winding roller 82 is formed, for example, to have a cylindrical shape, and is arranged to be rotatable in the Y direction as an axial direction on the −X side of the sheet P between the heating unit 50 and the fixing rollers 62. Specifically, the winding roller 82 is positioned on the +X side and the −Z side with respect to the end position of the inclined portion 54B of the cover 54, and is arranged at a position on the +Z side of the press roller 64. In addition, the winding roller 82 is formed, for example, of stainless steel (SUS). Moreover, the outer circumferential surface of the cleaning roller 32 is in contact with the side of an outer circumferential surface of the winding roller 82 that is opposite to a side which is in contact with the sheet P.

A halogen heater 84 as an example of an auxiliary heating section is arranged inside the winding roller 82 in a state of non-contact with an inner circumferential surface of the winding roller 82. The halogen heater 84 is electrified (power supply) from power supply (not illustrated) to heat the winding roller 82. An output of the halogen heater 84 is controlled based on a temperature that is detected by the temperature sensor (not illustrated) so that the white background portion is at 90° C. and the toner image TA is at 110° C. on the image surface PA of the sheet P after passing the heating unit 50.

Herein, the winding roller 82 folds the transport path of the sheet P from the heating unit 50 to the fixing rollers 62 to the side opposite to the image surface PA side from the extended line E of the transport path facing the heating unit 50 since the sheet P is wound around the outer circumferential surface of the winding roller 82. Moreover, the winding roller 82 allows the outer circumferential surfaces of the fixing rollers 62 to be positioned on the image surface PA side from the extended line E. In addition, the winding roller 82 rotates in response to the movement of the sheet P since the sheet P is transported in a state where the sheet P is in contact with the winding roller 82.

Effect

Next, effects of the second exemplary embodiment will be described.

In the fixing device 80 illustrated in FIG. 4, the transport path of the sheet P is folded to the no-image surface PB side from the extended line E by the winding roller 82. Accordingly, the far infrared rays (radiation) from the carbon heaters 52 rarely reach the fixing rollers 62 even though the far infrared rays (radiation) from the carbon heaters 52 are reflected and diffused by the reflection plate 56 and the sheet P. In other words, in the fixing device 80, the absorption of the far infrared rays that are not absorbed by the toner image TA and the sheet P by the fixing roller 62 (first-stage) is more suppressed than in the comparative example described above, and thus a rise in the temperature of the fixing rollers 62 (rise from the preset temperature) is suppressed.

In addition, in the fixing device 80, the winding roller 82 is driven to rotate due to the transport of the sheet P, and thus resistance that acts on the sheet P during the transport of the sheet P is smaller than in a configuration in which a member which folds the transport path of the sheet P does not rotate.

Moreover, in the fixing device 80, the sheet P is wound around the winding roller 82, and thus a contact area between the winding roller 82 and the sheet P increases and paper dust may adhere to the winding roller 82 compared to a case where the sheet P is not wound. However, in the fixing device 80, the cleaning roller 32 cleans the outer circumferential surface of the winding roller 82, and thus foreign substances (paper dust, dust, and the like) adhering to the outer circumferential surface of the winding roller 82 are removed. Accordingly, the adhesion (including retransfer of the paper dust) of the foreign substances to the sheet P is suppressed compared to a configuration in which the cleaning roller 32 is absent.

In addition, in the fixing device 80, the first-stage fixing roller 62 as an example of the contact member is set, and thus the distance from the heating unit 50 to the fixing portion 60 is shorter than in a configuration in which the contact member is a member other than the fixing roller 62. As such, dropping of the temperature of the sheet P, which passes the heating unit 50 and moves into the fixing portion 60, below the preset temperature is suppressed, and no unnecessary energy is consumed to heat the sheet P. Accordingly, the consumption of energy used to heat the toner T (refer to FIG. 3) is suppressed.

In addition, in the fixing device 80, moisture (water vapor) in the sheet P that is evaporated due to the heating by the heating unit 50 may adhere to the outer circumferential surface of the winding roller 82, but the water vapor is evaporated since the winding roller 82 is heated by the halogen heater 84. As such, dew condensation in the winding roller 82 is suppressed compared to a configuration which does not include the halogen heater 84. In addition, a decline in the temperature of the sheet P before passing the heating unit 50 and reaching the fixing portion 60 is suppressed since the winding roller 82 is heated.

Moreover, in the fixing device 80, the halogen heater 84 is disposed inside the winding roller 82, and thus the range of winding of the sheet P around the outer circumferential surface of the winding roller 82 may be adjusted regardless of the arrangement of the halogen heater 84 in a case where the change is desired.

Third Exemplary Embodiment

Next, examples of a fixing device and an image forming apparatus according to a third exemplary embodiment will be described. The same reference numerals as in the first and second exemplary embodiments will be attached to basically the same members and locations as in the first and second exemplary embodiments described above to omit description.

Figure 5:
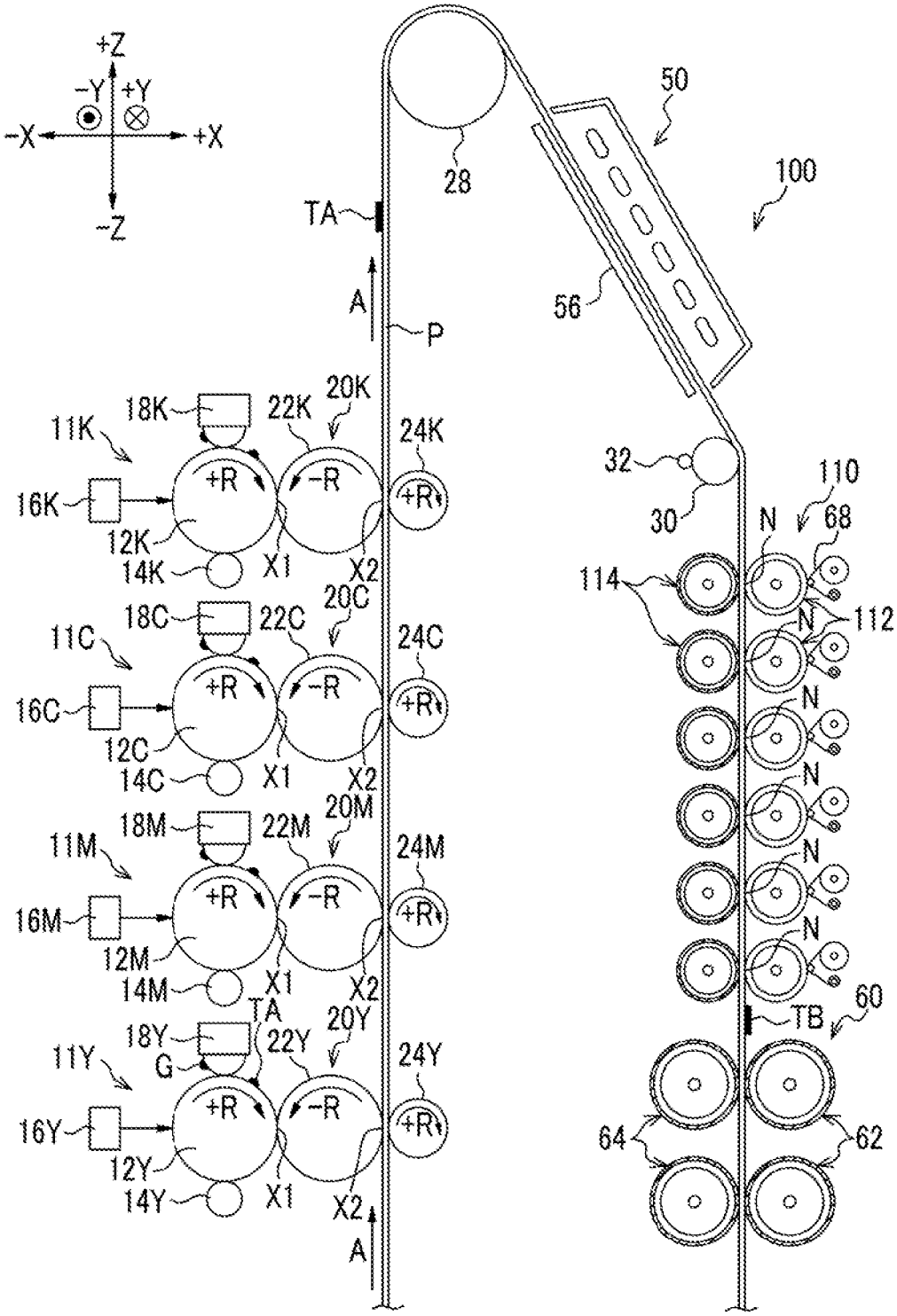
FIG. 5 is a schematic diagram illustrating a configuration of a fixing device according to a second exemplary embodiment.

FIG. 5 illustrates a fixing device 100 according to the third exemplary embodiment. In the fixing device 100, a temperature convergence unit 110 is configured to be disposed between the winding roller 30 and the fixing portion 60 in the image forming apparatus 10 according to the first exemplary embodiment (refer to FIG. 1).

Temperature Convergence Unit

Figure 6:
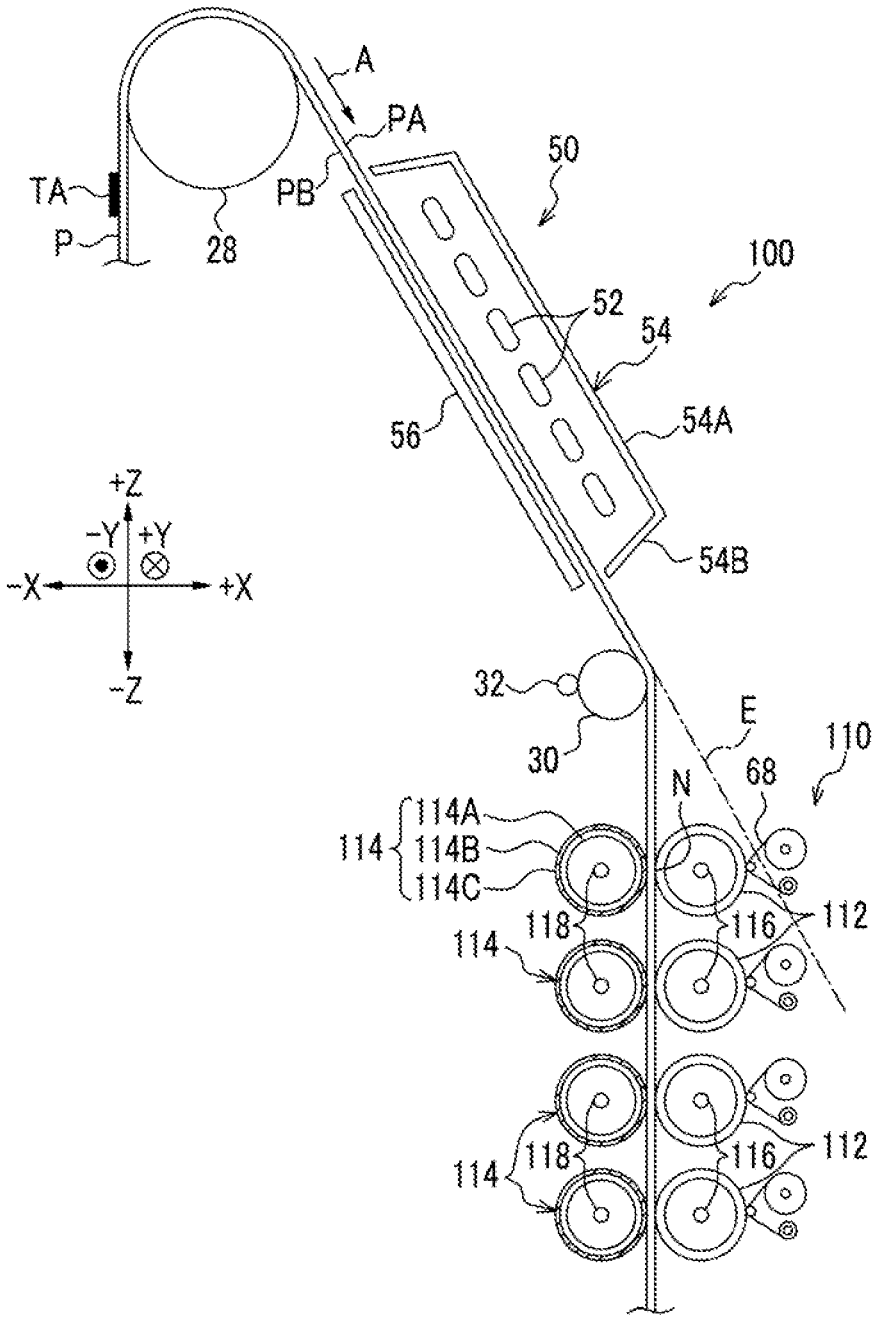
FIG. 6 is a schematic diagram illustrating a configuration of a fixing device according to a third exemplary embodiment.

As illustrated in FIG. 6, the temperature convergence unit 110 has metal rollers 112 as an example of a fixing preprocessing member and the contact member, facing rollers 114, halogen heaters 116 that heat the metal rollers 112, and halogen heaters 118 that heat the facing rollers 114. In addition, the temperature convergence unit 110 further has the cleaning webs 68 that are in contact with outer circumferential surfaces of the metal rollers 112. In this exemplary embodiment, the toner image is distinguished into a toner image TB (refer to FIG. 5) whose temperature is converged by the temperature convergence unit 110 and the toner image TA that has yet to be subjected to temperature convergence.

Metal Roller

The metal roller 112, as an example, is configured to have SUS hubs disposed in both axial end portions of a pipe material formed of SUS, and is 80 [mm] in outer diameter, 2.5 [mm] in radial thickness, and 580 [mm] in axial length. The metal rollers 112 are disposed to be rotatable in the Y direction as an axial direction on the downstream side from the winding roller 30 (upstream side from the fixing rollers 62 (refer to FIG. 5)) and on the +X side of the sheet P in the transport direction of the sheet P. As such, the metal rollers 112 are in contact with the toner image TA, as an example of fixing preprocessing, to converge the temperatures of the sheet P and the toner image TA to the preset temperature. In addition, the six metal rollers 112 are disposed at regular intervals in the transport direction (2 direction) of the sheet P, and the halogen heaters 116 are disposed inside the respective metal rollers 112.

In addition, the metal rollers 112 are arranged on the +X side of the sheet P and on the −X side from the extended line E described above in the Z direction since the transport path of the sheet P is folded by the winding roller 30. The metal rollers 112 are in contact with the toner image TA, and recover the wax WX (refer to FIG. 3). The winding roller 30 allows the outer circumferential surface of a first-stage metal roller 112 to be positioned on the image surface PA side from the extended line E. The first-stage metal roller 112 means the metal roller 112 that is at the closest position to the winding roller 30.

Facing Roller

The facing rollers 114 are formed to have a cylindrical shape, and are disposed to be rotatable in the Y direction as an axial direction on the −X side of the sheet P. In addition, the facing roller 114 has a multilayer structure that has a core roller 114A, an elastic layer 114B, and a release layer 114C from an inner side toward an outer side in the radial direction. Moreover, the facing rollers 114 are biased toward the metal rollers 112 by using a biasing section (not illustrated) such as a spring. In addition, the six facing rollers 114 are disposed at regular intervals in the transport direction (Z direction) of the sheet P, and the halogen heaters 118 are disposed inside the respective facing rollers 114.

The core roller 114A has a configuration in which SUS hubs are disposed in both axial end portions of a pipe material formed of an aluminum alloy. The elastic layer 114B is formed, for example, of silicone rubber with a radial thickness of 2.5 [mm] and a shore A hardness of A30. The release layer 114C is formed, for example, of PFA with a radial thickness of 100 [μm]. The facing roller 114 is, for example, 80 [mm] in outer diameter and 580 [mm] in axial length.

The metal rollers 112 and the facing rollers 114 are driven to rotate as the sheet P is transported in a state where the sheet P is in contact with and nipped by the metal rollers 112 and the facing rollers 114. Locations where the metal rollers 112 and the facing rollers 114 are contact with each other in a state where the sheet P is absent (locations where the sheet P is nipped) are referred to as the contact portions N.

Halogen Heater

The halogen heaters 116 are inserted in the Y direction inside the respective metal rollers 112. The halogen heaters 116 generate heat and heat the respective metal rollers 112 from the inside when electrified by power supply (not illustrated). In addition, the halogen heaters 116 are, for example, subjected to feedback control based on an output of a temperature sensor (not illustrated) that detects the temperature of the metal rollers 112 so that the temperature of the outer circumferential surface of the metal roller 112 is at 120° C. In other words, the halogen heaters 116 heat the metal rollers 112 to a temperature that is higher than the heating temperature in the heating unit 50 and is lower than the fixing temperature in the fixing portion 60 (refer to FIG. 5).

The halogen heaters 118 are inserted in the Y direction inside the respective facing rollers 114. The halogen heaters 118 generate heat and heat the facing rollers 114 from the inside when electrified by power supply (not illustrated). In addition, the halogen heaters 118 are, for example, subjected to feedback control based on an output of a temperature sensor (not illustrated) that detects the temperature of the facing rollers 114 so that the temperature of the outer circumferential surface of the metal roller 112 is maintained at 120° C.

The six metal rollers 112 may be moved to one of the −X side (contact side) and the +X side (withdrawal side) by a latch mechanism portion (not illustrated) from a position where the outer circumferential surfaces are separated from the sheet P as a starting point position. Likewise, the six facing rollers 114 may be moved to one of the +X side (contact side) and the −X side (withdrawal side) by the latch mechanism portion (not illustrated) from a position where the outer circumferential surfaces are separated from the sheet P as a starting point position.

When fixing is performed with the fixing portion 60 (refer to FIG. 5), the latch mechanism portion (not illustrated) moves the six metal rollers 112 from the starting point position to the −X side and moves the six facing rollers 114 from the starting point position to the +X side to nip the sheet P. In addition, when the fixing is not performed with the fixing portion 60, the latch mechanism portion moves the six metal rollers 112 from the contact portions N to the +X side and moves the six facing rollers 114 from the contact portions N to the −X side to withdraw from the sheet P.

The halogen heaters 116 and the cleaning webs 68 are moved in a state where the arrangement with respect to the metal rollers 112 is maintained, and the halogen heaters 118 are moved in a state where the arrangement with respect to the facing rollers 114 is maintained. In addition, load application to the contact portions N, where the metal rollers 112 and the facing rollers 114 are in contact with each other, is by a constant load method with a load value of, for example, 735 [N].

Effect

Next, effects of the third exemplary embodiment will be described.

As illustrated in FIG. 5, the toner image TA that is formed on the sheet P is heated by the heating unit 50, and moves into the temperature convergence unit 110 in a state where the toner image TA is separated into the binder resin and the release film.

Next, in the temperature convergence unit 110, the sheet P passes the six contact portions N so that the temperatures of the sheet P and the toner image TA, which are greatly different from each other, are converged in stages to the preset temperature (for example, 120° C.). In this case, the offset of the toner T (refer to FIG. 3) to the metal rollers 112 is unlikely to occur since the release film (release layer) is present on the surface of the toner image TA due to the wax WK (refer to FIG. 3). However, if the preset temperature of the metal rollers 112 is excessively high, the wax WX is likely to flow outside from between the metal rollers 112 and the toner T, and thus it has to be considered how to make the offset unlikely to occur.

As described above, the metal rollers 112 are configured by using an SUS pipe material, and thus the temperature history is unlikely to remain. In addition, the six sets of the metal rollers 112 and the facing rollers 114 are arranged in the temperature convergence unit 110, and thus the temperature difference between the toner images TA of the respective colors is reduced toward the downstream side in the transport direction of the sheet P (refer to FIGS. 7A and 7B described later). In this manner, in the temperature convergence unit 110, the temperatures of the toner images TA on the sheet P are converged to the preset temperature. Since the wax WX adhering to the outer circumferential surfaces of the metal rollers 112 is removed by the cleaning webs 68, adhesion of the wax WK to the sheet P is suppressed.

Next, the toner images TB, in which the temperatures of the portions of the respective colors are converged to the preset temperature, are heated and pressurized in the fixing portion 60 and are fixed on the sheet P. Herein, the glossinesses of the toner images fixed on the sheet P have approximately equal values in the portions of the respective colors since the temperatures of the portions of the respective colors of the toner images TB are converged to the preset temperature (temperature difference in the width direction orthogonal to the transport direction is reduced).

Figure 7A:
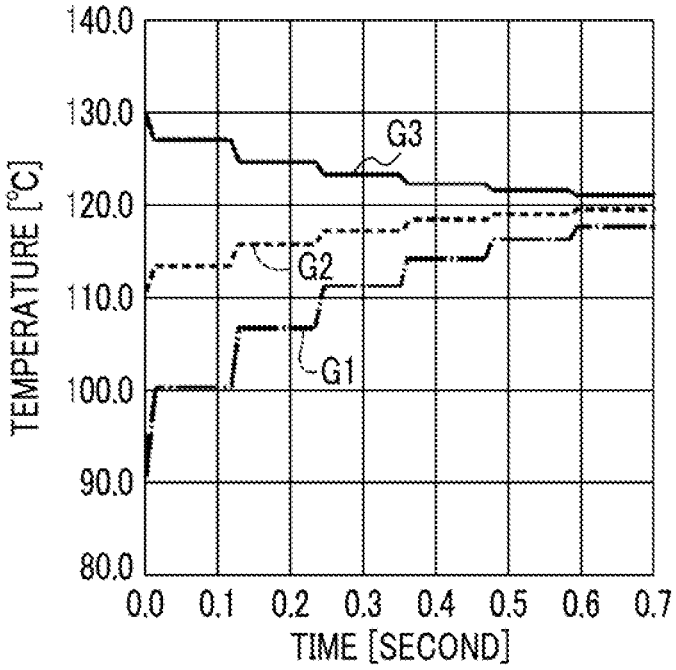
FIG. 7A is a graph illustrating temperature convergence states of a white background portion, a one-surface toner portion, and a two-surface toner portion with respect to time when the width of a contact portion according to the third exemplary embodiment is 5 mm at a preset temperature of 120° C.

FIG. 7A illustrates temperature change in each of the portions with respect to time at a time when the width of one of the contact portions N in the transport direction of the sheet P is 5 [mm] and the preset temperature (convergence target temperature) is 120° C. In FIG. 7A, graph G1 is a temperature of the white background portion PW (refer to FIG. 3) of the sheet P, and graph G2 is a temperature of the black portion on one surface of the sheet P (one-surface toner portion). Moreover, graph S3 is a temperature of the black portions on both surfaces of the sheet P (two-surface toner portion).

Figure 7B:
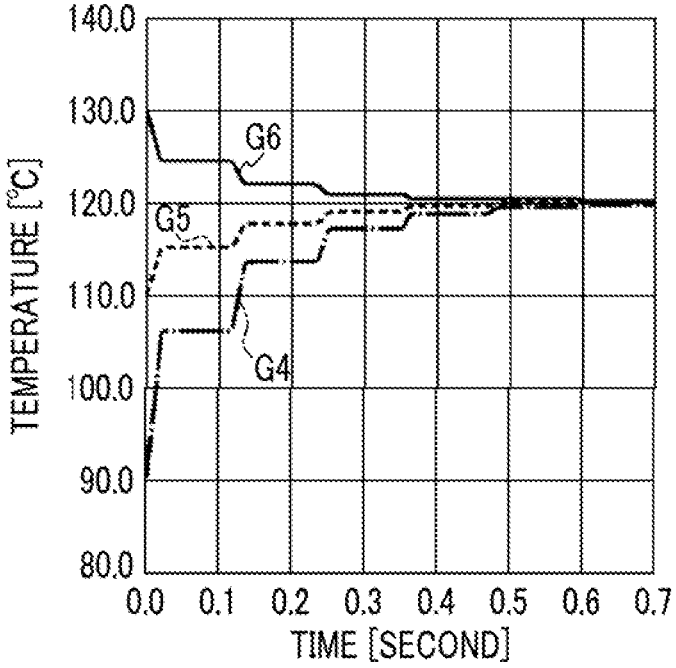
FIG. 7B is a graph illustrating temperature convergence states of the white background portion, the one-surface toner portion, and the two-surface toner portion with respect to time when the width of the contact portion according to the third exemplary embodiment is 15 mm at a preset temperature of 120° C.

FIG. 7B illustrates temperature change in each of the portions with respect to time at a time when the width of one of the contact portions N (refer to FIG. 2) in the transport direction of the sheet P is 15 [mm] and the preset temperature (convergence target temperature) is 120° C. In FIG. 7B, graph G4 is a temperature of the white background portion PW (refer to FIG. 3) of the sheet P, and graph G5 is a temperature of the black portion on one surface of the sheet P (one-surface toner portion). Moreover, graph G6 is a temperature of the black portions on both surfaces of the sheet P (two-surface toner portion).

Each of the temperatures is a value calculated by heat conduction calculation. In addition, in the graphs G1, G2, G3, G4, G5, and G6, six time periods when the temperatures rarely change (stabilized) are present, which correspond to the temperature of the sheet P between passing the contact portion H and reaching the next contact portion N. In this area, the temperature of the sheet P is actually measured by using a radiation thermometer to correspond to the calculated value.

As illustrated in FIG. 7A, the temperatures of the respective portions are not converged to 120° C. even after the sheet P passes the six contact portions N when the width of the contact portion N (refer to FIG. 2) is 5 [mm]. In FIG. 7B, it is confirmed that the temperatures of the respective portions are converged to approximately 120° C. at a point of time when, the sheet P passes the six contact portions N when the width of the contact portion K is 15 [mm]. In other words, it is confirmed that the temperatures of the respective portions on the sheet P may be converged to the preset temperature by adjusting the width and the number of the contact portions N.

Herein, the transport path of the sheet P is folded to the no-image surface PB side from the extended line E by the winding roller 30 in the fixing device 100 illustrated in FIG. 6. Accordingly, the far infrared rays (radiation) from the carbon heaters 52 rarely reach the metal rollers 112 even though the far infrared rays (radiation) from the carbon heaters 52 are reflected and diffused by the reflection plate 56 and the sheet P. In other words, in the fixing device 100, the heating of the metal roller 112 (first-stage) by the far infrared rays (radiation) that are not absorbed by the toner image TA and the sheet P is suppressed compared to the comparative example described above, and thus the rise in the temperature of the metal rollers 112 (rise from the preset temperature) is suppressed.

In addition, in the fixing device 100, the first-stage metal roller 112 is set as an example of the contact member, and thus the distance from the heating unit 50 to the fixing portion 60 is shorter than in a configuration in which the contact member is a member other than the metal roller 112 (or the fixing roller 62). As such, dropping of the temperature of the sheet P, which passes the heating unit 50 and moves into the fixing portion 60, below the preset temperature is suppressed, and no unnecessary energy is consumed to heat the sheet P. Accordingly, the consumption of energy used to heat the toner T (refer to FIG. 3) is suppressed.

The invention is not limited to the exemplary embodiments and the modification examples described above.

A quartz lamp, a flash lamp, an oven heater, or the like may also be used in the heating unit 50 instead of the carbon heater 52. In addition, the number of the carbon heaters 52 is not limited to six, and may be any number other than six. Moreover, the heating unit 50 may not have the reflection plate 56. Other resins not limited to the polyester resin may be used in the toner T.

The fixing portion 60 may adopt a belt type, not limited to the roller type in which the fixing rollers 62 and the press rollers 64 are used. In addition, one set or at least three sets of rollers may be used in the fixing portion 60, not limited to the use of the two sets of the rollers.

The material of the metal roller 112 is not limited to SUS, and the metal roller 112 may be configured by using an aluminum alloy or other metals. In a case where the metal roller 112 is formed, for example, of an aluminum alloy, the wall thickness of a pipe portion may be approximately 7.5 [mm] in view of roller deflection. Moreover, a fluorine resin layer of tens of [μm] may also be disposed on the surface of the metal roller 112 so as to improve releasability. In addition, the metal roller 112 may be driven by a motor, not limited to being driven to rotate in response to the movement (transport) of the sheet P. In addition, the facing rollers 114 may be configured to be fixed members that do not rotate.

The folding member is not limited to the rotating body that rotates, such as the winding rollers 30 and 82, and may be a fixed member that is fixed to an apparatus main body to allow sliding of the sheet P. In addition, the cleaning roller 32 may not be disposed in the winding rollers 30 and 82 in a case where there is no problem associated with foreign substance adhesion. Moreover, the winding rollers 30 and 82 may be driving rollers that are rotated by a motor (driving source), not limited to being driven to rotate. When the winding rollers 30 and 82 are the driving rollers, flapping (change in posture) during the transport of the sheet P is more suppressed than in a case where the winding rollers 30 and 82 are the driven rollers. In a case where the winding rollers 30 and 82 are the driving rollers, rubber may be disposed in outer circumferential portions.

In the fixing device 100 according to the third exemplary embodiment, the winding roller 82 may be disposed instead of the winding roller 30 with the halogen heater 84 further disposed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating section that is arranged to be out of contact with a recording medium which is transported, and heats a developer image on the recording medium;

a contact member that is arranged on a downstream side from the heating section in a transport direction of the recording medium, and is in contact with an image surface on a developer image side of the recording medium; and a folding member that is arranged between the heating section and the contact member, and folds a transport path of the recording medium from the heating section to the contact member to a side opposite to an image surface side from an extended line so that the contact member is positioned on the opposite side of the heating section from an extended line of the transport path which faces the heating section, wherein the contact member is a preprocessing member downstream from the folding member, the preprocessing member including a temperature convergence section that converges a temperature of the recording medium to a preset temperature.

2. The fixing device according to claim 1, further comprising:

an auxiliary heating section that heats the folding member.

3. The fixing device according to claim 2, wherein the folding member is a rotating body that is rotated in response to a movement of the recording medium.

4. The fixing device according to claim 3, further comprising:

a cleaning section that cleans a surface of the folding member that is in contact with the recording medium.

5. The fixing device according to claim 1, wherein the folding member is a rotating body that is rotated in response to a movement of the recording medium.

6. The fixing device according to claim 5, further comprising:

a cleaning section that cleans a surface of the folding member that is in contact with the recording medium.

7. The fixing device according to claim 6, wherein the cleaning section contacts the folding member at a farthest point, along a horizontal axis, from a point at which the folding member contacts the recording medium.

8. The fixing device according to claim 1, further comprising a fixing member that fixes the developer image on the recording medium, the fixing member being arranged on the downstream side in a trans port direction from the processing member.

9. An image forming apparatus comprising:

the fixing device according to claim 1; and a developer image forming unit that forms a developer image on a sheet which is transported to the heating section.

10. The image forming apparatus according to claim 9, wherein developer used in the developer image forming unit is powder toner which uses a polyester resin as a main ingredient.

11. The fixing device according to claim 1, wherein the folding member folds the transport path in such a manner that a portion of the transport path downstream from the folding portion extends in a substantially vertical direction through the contact member.

* * * * *